US006314887B1

(12) United States Patent
Robinson

(10) Patent No.: US 6,314,887 B1
(45) Date of Patent: Nov. 13, 2001

(54) MICROELECTROMECHANICAL SYSTEMS (MEMS)-TYPE HIGH-CAPACITY INERTIAL-SWITCHING DEVICE

(75) Inventor: Charles H. Robinson, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/556,989

(22) Filed: Apr. 24, 2000

Related U.S. Application Data

(60) Provisional application No. 60/184,137, filed on Feb. 22, 2000.

(51) Int. Cl.[7] ..... F42C 15/40
(52) U.S. Cl. ..... 102/262
(58) Field of Search ..... 102/222, 247, 102/262, 235

(56) References Cited

U.S. PATENT DOCUMENTS 5,705,767 * 1/1998 Robinson ..... 102/231
6,064,013 * 5/2000 Robinson ..... 200/61.53
6,167,809 * 1/2001 Robinson et al. ..... 102/235

* cited by examiner

*Primary Examiner*—Charles T. Jordan
*Assistant Examiner*—Jordan M Lofdahl
(74) *Attorney, Agent, or Firm*—John F. Moran; Michael C. Sachs; Robert C. Beam

(57) ABSTRACT

Various ultra-miniature, monolithic inertial switching (G-switch) devices used in safety and arming (S&A) devices for projected munitions, which operate in accordance with a shuttle member (50), which effectuates current switching of around an ampere of current when subjected to a threshold inertial loading (for example, an impact or gun launch of a projection munition). The embodiments of the invention can be a passive threshold G-switch with or without switch enable and arming capability. The embodiments (100, 200) of the invention use either mechanical or electromechanical switch enable functioning and can optionally include a shuttle time-delay feature (54). Both embodiments can incorporate various designs for a switching assembly (75) such as latching single-throw switch having the configurations of either a normally-open, double pole, single-throw switch or a normally-open, single pole, single-throw switch, wherein switch closing occurs when the shuttle member (50) experiences inertial loading and penetrates the switching assembly (75).

20 Claims, 10 Drawing Sheets

MICROELECTROMECHANICAL SYSTEMS (MEMS)-TYPE HIGH-CAPACITY INERTIAL-SWITCHING DEVICE

CROSS REFERENCE RELATED APPLICATIONS

This application claims priority from U.S. Provisional Application Ser. No. 60/184,137 filed on Feb. 22, 2000. Also, this application is related to U.S. patent applications Ser. No. 09/192,805 filed Nov. 5, 1999 entitled "ULTRA-MINIATURE, MONOLITHIC, MECHANICAL SAFETY-AND-ARMING (S&A) DEVICE FOR PROJECTED MUNITIONS," and U.S. patent applications entitled, "Microelectromechanical Systems (MEMS)-Type Devices Having Latch, Release and Output Mechanisms" and "Ultra-Miniature Mechanically Enabled Detonator With Safety and Arming Device," filed herewith, the contents of which are expressly incorporated in their entirety herein.

U.S. GOVERNMENT INTEREST

The invention described herein may be manufactured, used, and licensed by or for the U.S. Government for U.S. Government purposes.

FIELD OF THE INVENTION

The present invention relates generally to microelectromechanical systems (MEMS)-type devices and, more particularly, to microelectromechanical safety-and-arming (S&A) devices used in fuzing applications.

DESCRIPTION OF THE PRIOR ART

Explosive projectiles, such as mortar shells, artillery shells and other similar projectiles, normally have an S&A device, which operates to permit detonation of the explosive only after the projectile has been fired or launched. Thus, mechanical arming delay mechanisms for such projectiles or explosives are well known in the art.

For example, three-dimensional rotary or linear zigzag delay (that is, inertial delay) devices on the scale of millimeters or centimeters, fashioned by precision machining, casting, sintering or other such "macro" means, have previously been used to provide a mechanical delay before closing a switch, or removing a lock on a detonator slider in a fuze S&A device. Such devices are disclosed, by way of example, in U.S. Pat. Nos. 4,284,862 and 4,815,381. However, fabrication of such devices is costly since such devices are constructed from extremely precision components, often requiring time-consuming component sorting, thus limiting their use.

Other mechanical arming delay mechanisms include sequential falling leaf-spring mechanisms and escapement mechanisms. The technology surrounding such devices also includes rotors or sliders which, as arming proceeds, move out-of-line fire-train components toward and into an in-line position. Typically, the out-of-line element is a detonator or squib (propellant initiator). In such devices, the rotor or slider can remove an explosive barrier that has blocked function of the fire train, thereby arming the device.

Finally, such devices also include arrangements wherein mechanical sequential interlocks control motion of a slider/rotor mechanism such that out-of-sequence actuation of the interlocks leads to a fail-safe condition. An example of out-of-sequence actuation includes a spin lock releasing an arming slider before a setback lock has functioned to release the arming slider.

Overall, prior art arrangements are such that mechanical fuze S&A devices comprise complicated, three-dimensional assemblies of piece-parts working together inside of a frame, collar or support housing. The piece-parts interact to provide dual-environment, out-of sequence safety and arming functions. Complexity comes from the need for pins, screws, bushings, specialty springs, lubrication, dissimilar materials, and assembly, as well as a need for maintaining small tolerances on all parts for trouble-free operation.

In summary, there is need in the fuze arts, as similarly discussed in my related U.S. patent applications referenced above, for ultra-miniature, monolithic, mechanical fuze S&A devices for munitions. More particularly, there is need for fuze mechanical S&A device designs that are significantly smaller and more reliable, which have varied electrical control switching action, thereby providing more space in the munitions for payload or electronics. In addition, there is need for development of a fuze S&A device fabrication techniques that can replace or reduce dependence on a disappearing, domestic precision small-parts manufacturing base. Furthermore, there is need for development of fuze S&A device designs that allows fuze developers and manufacturers to make changes to design thereof involving non-complex exposure-mask and process-parameter changes to the MEMS micromachining process, compared to expensive factory retooling currently used to achieve the same goal when using conventional mechanical components. Additionally, there is need for improvement in how these S&A devices are interfaced and integrated with increasingly electronics-intensive fuze designs. Moreover, there is a need for the development of improvements in potential shelf-life of mechanical S&A devices, taking advantage of inherent characteristics of microscale moving parts that do not require lubrication that degrades with time in conventional mechanisms. Finally, there is need for improved safety and reliability of fuzing devices by incorporating redundant functions that can be built and tested by high-rate micromachining production processes.

Such needs are addressed by further research and development of LIGA (LIthographie, Galvanoformung, Abformung, for "lithography, electroplating, molding") micromachining processing methods that use metals, polymers and even ceramics for the production of varied microstructured devices having extreme precision. These collective microstructures are implemented as microelectromechanical systems (MEMS) that are alternatives for conventional discrete electromechanical devices such as relays, actuators, and sensors. When properly designed, MEMS-type actuators produce useful forces and displacement, while consuming reasonable amounts of power. MEMS-type devices are low cost devices, due to using microelectronic fabrication techniques.

Using MEMS micromachining methods, I previously disclosed a miniature, planar, inertially-damped, inertially actuated delay slider actuator micromachined on a substrate, which included a slider in cooperation with a zig-zag or stair-step-like pattern on side edges for a time delay mechanism for a S&A device in U.S. Pat. No. 5,705,767, as discussed below. The present invention provides additional MEMS-type switching devices for use with S&A devices in view of the above mentioned needs in the fuze arts.

OBJECTS AND SUMMARY OF THE INVENTION

It is a primary object of the present invention to provide MEMS-type inertial switching (G-switch) devices, in a threshold non-enabled type, an enabled electromechanical-type and an enabled mechanical-type switching device, for relatively high electrical current capacity switching applications, which resolves problems related to fuzing applications as discussed above.

It is another object of the present invention to provide novel MEMS-type inertial switch (G-switch) devices, which incur lower production cost compared to conventional devices now used.

It is yet another object of the present invention to provide a MEMS-type inertial switch (G-switch) device particularly adapted for use in S&A devices forming part of a fuze in projected munitions.

Briefly, various high-aspect-ratio MEMS-type inertial switching (G-switch) devices are provided that can electrically switch up to about an ampere of current when subjected to a threshold acceleration (for example, an impact or gun launch of a projection munition). These switching (G-switch) devices are typically used with safety and arming (S&A) devices for projected munitions. The two embodiments of the invention can be a passive threshold G-switch without an enable capability. Both embodiments of the invention either by mechanical or electromechanical enable capability allow switching to occur. Either of these embodiments can also incorporate a shuttle time-delay capability. Both embodiments of the invention can be one of multiple designs for a switching assembly. These switching assembly designs can be a latching single-throw switch having a configuration of either a normally-open, double pole, single-throw switch or a normally open, single pole, single-throw switch. Switching action occurs when the shuttle member experiences inertial loading and penetrates the anvil closure member.

The G-switching devices of the invention can be used in various military applications by providing a mechanically-enabled, latching mechanical inertial switch (G-switch) device; an electromechanically enabled latching mechanical G-switch device; a miniature unpowered inertial t-zero or power switch device to enable electronic circuits within either gun-launched or tube-launched based weapons or instrumentation packages (for example, flight recorders or telemetry packages). The environments in which the invention can be used include sea- and water-vehicles, space borne instrumentation packages, and safety and emergency response systems. The G-switch devices can function in non-lethal weapons, by virtue of the small size and weight. The MEMS-type device is smaller, thus less massive, and can be considered "frangible" in association with an electromechanical assembly that it forms part of.

The above remarks, and other objects, features and advantages of the present invention will become apparent from the following description read in conjunction with the accompanying drawings, in which like reference numerals designate the same element and functional type of assembly.

DETAILED DESCRIPTION OF THE PREFERRED EMBODIMENTS

Figure 1:
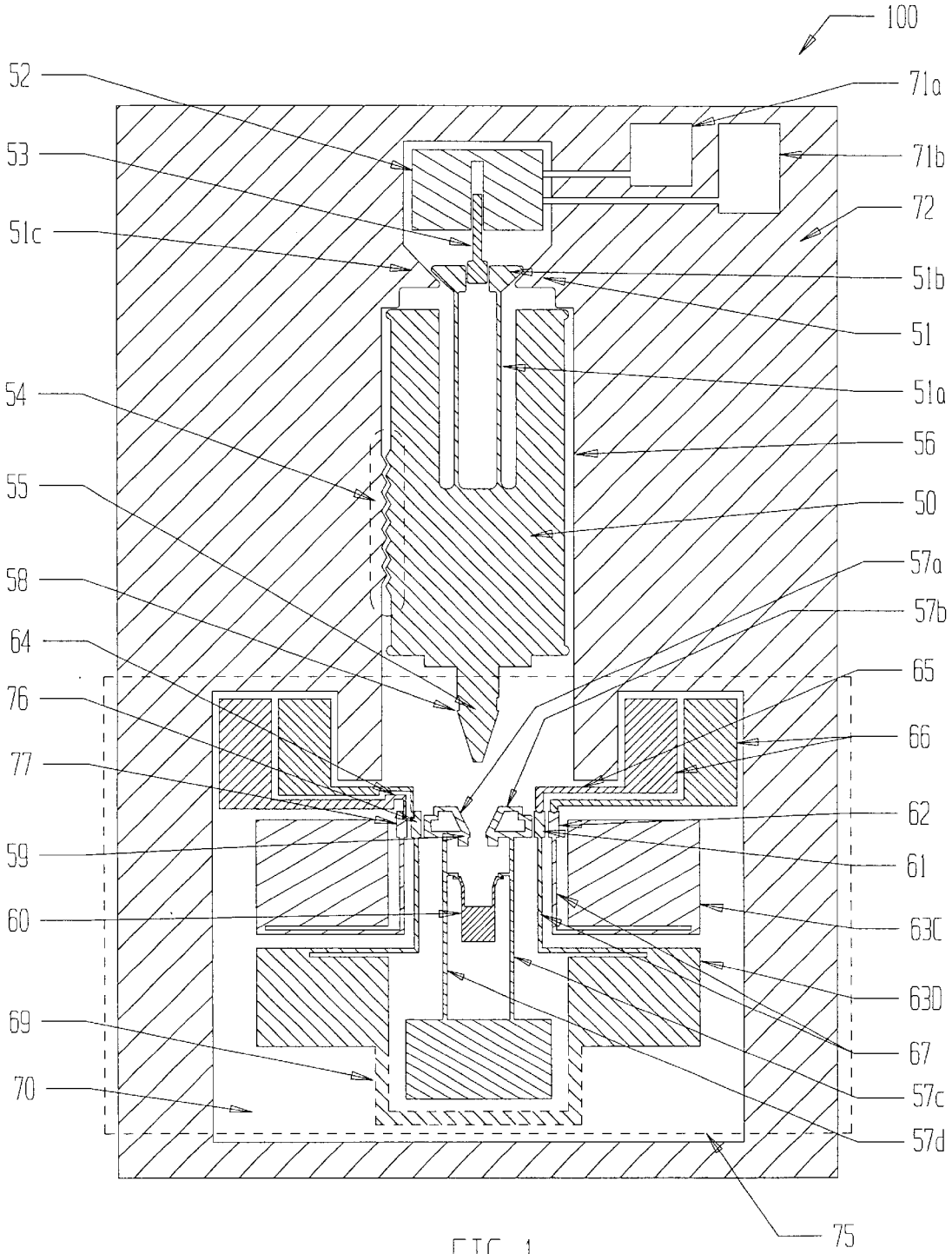
FIG. 1 shows an exemplary sectional plan view of a first embodiment of a MEMS unpowered G-switch with electromechanical enable capability.

FIRST EMBODIMENT OF INVENTION: Referring now to FIG. 1, a first embodiment of the invention is shown in a sectional plan view of a MEMS-type unpowered G-switch device 100 with electromechanical enable capability. This switching device comprises an actuator component 52 that provides enablement of the switch device 100, a shuttle member 50, an anchor assembly 51 that includes the following members of anchor legs 51*a,* anchor feet 51*b* that are attached to the shuttle member and are shaped to bear laterally against constriction members 51*c;* and one of several designs of a switching assembly 75. Each constriction member 51*c* has a cam face that is attached to the substrate 70 and forming part of a raised structural upper section of the MEMS-type device and shown as just one of many "land" structures 72 that form this raised section. After the anchor feet are unpinned by upward movement of a linchpin 53 and out from between the feet 51*b,* the anchor feet can slide past these constriction members allowing the shuttle 50 to be pulled downwards by inertia when subjected to a threshold accelerating event, resulting in switching action by the switch assembly 75 when a shuttle head member 55 attached to the shuttle 50 makes contact with contact hammers 57*a* and 57*b.*

In particular, when the linchpin 53 is removed, the gap between the left and right anchor feet 51*b* is sufficient for the feet to be deflected towards each other without interference to exit the constriction 51*c,* which is a symmetrical throat area that traps the anchor feet 51*b.* The angle of the cam face partially determines the force and stroke necessary to pull the feet through the constriction. A more vertical angle makes it easier to pull the feet through the constriction, but means a longer pullout stroke for a given amount of lateral deflection of the anchor feet. The linchpin 53 spaces the anchor feet apart and prevents them from clearing the constriction 51*c.* The linchpin can be pulled out of the lock by some applied upwards force to allow the anchor feet to pull through the constriction.

To enable the switch device 100 as shown in FIG. 1, the electromechanical actuator 52 effectuates removal of the movable linchpin 53 from the shuttle's anchor feet 51*b* upon electrical signal command from a controller (not shown) that is connected to the actuator 52 via bond pads 71*a* and 71*b,* thus causing the switch device 100 to be enabled and armed.

The enable and arming function is accomplished by removal of the linchpin 52 from between the shuttle anchor feet. Removal of the linchpin is electromechanically effectuated by either magnetic or thermal mechanisms characterized by low-force, small-stroke action that is applied to the linchpin. An example of such the actuator 52, is taught in U.S. Pat. No. 5,994,816 entitled, "Thermal arched beam microelectromechanical devices and associated fabrication methods." The electromechanical actuator 52 requires a low power input signal for control compared to much greater power handling capabilities of the switching assembly 75.

So long as the actuator 52 keeps the linchpin inserted in the anchor feet 51*b,* the shuttle cannot move even though an inertial loading (acceleration) is applied that would make the shuttle move, and if the actuator removes the linchpin from the anchor feet, the shuttle will then be free to respond to an acceleration along its axis. Thus the electromechanical actuator 52 provides the function of a time-gated enablement of the G-switch device 100, so the G-switch can be enabled, disabled, or re-enabled for different "windows" of time, based on an electrical input to the actuator 52 by a controller (not shown), that controls the movement of the linchpin 53.

When the switch device 100 is enabled and armed, the shuttle 50 can move down the slide track 56 due to inertia when the device 100 is subjected to inertial loading, thus providing switch closure of the switch assembly 75, by inserting shuttle head 55 between the contact hammers 57*a* and 57*b.* The shuttle 50 must have sufficient mass to respond to a predetermined threshold inertial forces acting upon the switch device 100. A tapered shuttle head 55 is attached the shuttle member that can insert between the contact hammers 57*a* and 57*b,* thus causing switch closure of any one of the designs of the switch assembly 75; the shuttle head 55 has catch members 58 that engage with catch engagement features 59 on contact hammers 57*a* and 57*b;* and flat sides for sliding in slide track 56.

Alternatively, instead of using the substantially straight edges for the track 56, a zig-zag track 54 (shown on one side only, but would be on both sides if used) can be used in place thereof that can attach to the sides of the slide track 56 to provide time-of-travel delay of a downward moving shuttle 50 when activated. This feature is taught in U.S. Pat. No. 5,705,767, entitled "Miniature, planar, inertially-damped, inertially-actuated delay slider actuator," which is hereby incorporated by reference. In particular, this patent teaches of a miniature, planar, inertially-damped, inertially-actuated delay slider actuator that is micromachined on a substrate that includes a "slider member" (a member that slides in a similar manner as the shuttle member 50 herein), with zig-zag or stair-step-like patterns on the side edges (as shown on only one side of the track 56 in FIG. 1) interacting with similar vertical-edged zig-zag patterns "teeth" on "racks" that are positioned across a small gap on each side of the "slider." In the present invention, as the shuttle 50 is drawn along the track such that the right edge of the slider engages with teeth on the right rack. The zig-zag rack and track member 54 causes the shuttle 50 to move back and forth as it slides down the faces on the both racks, until it is thrown clear of both racks. In this way, the shuttle zig-zags under inertial forces as it moves axially down the track toward the end thereof to actuate the electrical switch assembly 75, thus effectuating a required mechanical programmed time delay feature. An example of a need for this feature would be where there is need for delay for turning on a projectile's test instrumentation package until the munition has nearly exited a gun fired from. This feature can be used with the second embodiment of the invention discussed below.

In operation, the switch device 100 is initially enabled by the actuator 52 that effectuates a relatively small force to remove the linchpin 53 from the anchor feet 51*b*. Then, when sufficient acceleration of the device 100 occurs, the shuttle 50 is free to move and exert its inertial force upon the switch assembly 75. Thus, the device 100 requires relatively low power input signals to enable and arm the device 100 so that the shuttle 50 can respond to a predetermined threshold inertial loading of the switch device 100. Although the actuation of the actuator 52 requires an external electrical power input, the shuttle member is unpowered and operated by inertial loading of the device 100.

Figure 7A:
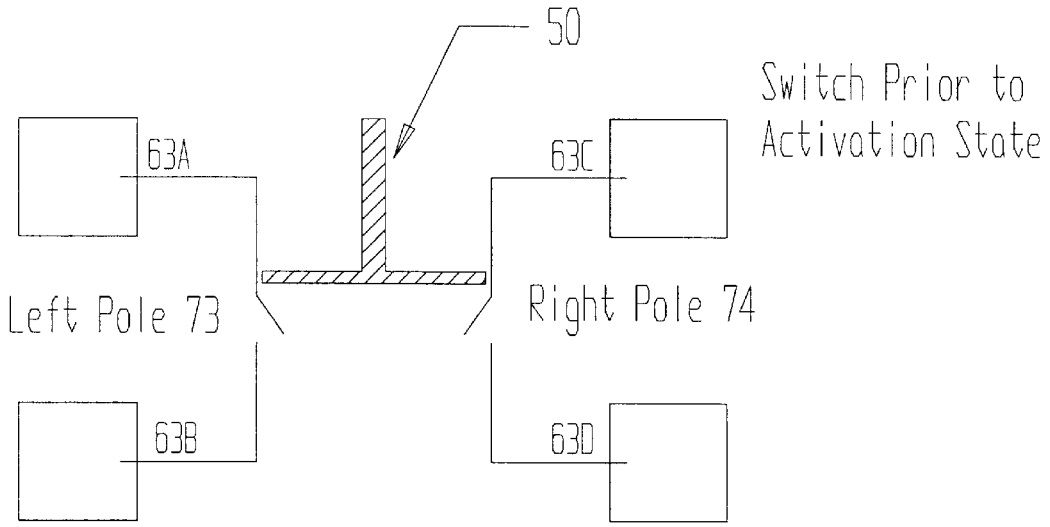
FIGS. 7*a,* 7*b,* 7*c,* 7*d,* 7*e* and 7*f* are diagrams showing various types of switching assemblies that can be used in the embodiments of the invention.

The electromechanical actuator 52 is powered through the two bond pads 71*a* and 71*b*. There may be more bond pads, as necessary, to operate the electromechanical actuator (for example, two pads for power and one for control, (not shown)). When the switch device 100 is not enabled, the preferred initial state of the switch is with the linchpin 53 situated between the two anchor feet 51*b,* which prevents the feet from pulling through the constriction 51*c* when loaded by anchor legs 51*a* as a result of an applied acceleration to the device. In this state, the shuttle is anchored and cannot move along its vertical track toward the switch assembly 75. The electrical path between pads 63A and 63B is open because the contact anvils 61 and 62 are not touching. The voltage standoff is determined by the gap between the anvils and the dielectric constant in the gap. Neither the substrate 70 nor the cover plate of the device 100 is conductive. Thus the "pole" between electrical contacts 63A and 63B is open. The case is similar with the other pole between contact pads 63C and 63D, and anvils 76 and 77. This is shown in FIG. 7*a*.

In FIG. 1, the switch device 100 is enabled and armed when the electromechanical actuator 52 receives a command from a controller (not shown) or circuit logic telling it to energize and pull the linchpin out from between the anchor feet. Once enabled, the shuttle 50 can now respond to a subsequent inertial loading state that pulls it downward with sufficient force to exceed a pull-out threshold force of the anchor feet 51*b* through the constriction 51*c*. Once this acceleration is reached, the shuttle pulls free and under continuing acceleration moves down the slide track 56 toward the switch assembly 75 and engages therewith. A mechanical delay function can be added to the shuttle travel process by including a zig-zag inertial delay feature as discussed above. Then, when subjected to inertial loading, the shuttle gains speed and thrusts the shuttle head 55 between the contact hammers. Because of the significant taper of the head and angle of the accepting "jaws" formed by the contact hammers, considerable lateral force develops so that contact anvil pairs 61 and 62 and 76 and 77 are pressed together. This closes the electrical contacts of the two poles of the switch, so that bond pad 63A is now connected to 63B and bond pad 63C is now connected to 63D. The anvils and anvil arms are electrically conductive. This is discussed and shown in FIG.7*b*.

To prevent re-opening of the switch device 100, catch features 58 on the shuttle head 55 and catch features on the contact hammers 57*a* and 57*b* engage once the shuttle head 55 enters the switch assembly 75, and hold the shuttle in a closed-switch position. Prior to latching and closing the switch, and to prevent inadvertent closure of the switch poles prior to shuttle movement, standoffs members 64 hold the contact hammers 57*a* and 57*b* in place and to keep the switch poles anvils 61 and 62, and 76 and 77 separated. The several standoff arms, and the several attachment lands 66, are structurally and electrically separated from each other so as to prevent shorting of the switch device.

Alternatively, the electromechanical enable function of the switching device 100 can be optional by omitting the electromechanical actuator 52 and the linchpin 53 components so that the anchor feet 51*b* are unpinned, resulting in a threshold G-switch device wherein the shuttle 50 pulls the anchor feet away from the constriction 51*c* when a threshold loading is exceeded.

SECOND EMBODIMENT OF INVENTION: Now referring to FIGS. 2*a* and 2*b,* a second embodiment of the G-switch device with enable capability is shown in sectional plan views. This embodiment is a switching device 200 that comprises a linchpin lift arm and support assembly 85, an anchor foot assembly 51 having components 51*a,* 51*b* and 51*c*, a shuttle member 50, and another design of the switching assembly 75. The support assembly 85 includes a movable linchpin 53 connected to lift arm transverse member 95 that is controlled by a linchpin lift arm 94, which in turn is supported by a support member 93 when the lift arm is flexed over until its top part engages with a capture feature on the end of the linchpin lift arm as shown in FIG. 2*b*. Actuation of the linchpin lift arm is accomplished by an externally coupled actuator such as a pressure switch, a rotatable cam member or a linear actuator. Movement of the linchpin caused by the external actuator (not shown) by mechanical coupling has sufficient stroke and power to control actions of the linchpin 53.

To enable and arm the switching device 200, a similar anchor foot assembly 51 is provided wherein removal of the linchpin 53 between the anchor feet 51*b* enables and arms the switch device 200. Enabling of the switch device is by a low-force, small-stroke mechanical force applied to the linchpin member. Once lifted, the linchpin cannot re-enter the anchor assembly 51. The linchpin and its support arms are released from the device substrate. FIG. 2*b* shows the device 200 when the linchpin 53 is moved upwards, and the shuttle 50 traveled downwards in the slide track 56, and the shuttle head 55 deflects and contacts the contact arms 92 causing switch-closure of the switch assembly 75.

In operation, the displaced shuttle 50 can move when the anchor feet 51*b* are unpinned. The shuttle, which is released from the substrate, can move downwards in the slide track 56 by inertial forces by an upward acceleration of the entire device 200. Additionally, the zig-zag track can be included with this embodiment of the invention in a similar manner as discussed above for required time-delay operational characteristics. A certain threshold acceleration level must be exceeded to overcome friction and the spring rate of the anchor legs 51*a,* which must deflect inwards to clear the anchor feet 51*b* of the constriction 51*c*. Under continuing inertial load, the shuttle pulls free of the anchor assembly and travels downward in the slide track 56, until the shuttle head 55 inserts between the electrode contact arms 92, electrically connecting the left contact arm to the right contact arm. The head of the shuttle 50, if not the whole shuttle, is made of or coated with a conductive material, so that it can electrically bridge the gap between the two contact arms 92, which are also conductive. The contact arms 92 provide switching capability by inserting the shuttle head 55 between the two electrode contact arms 92, where by spring forces, the contacts and shuttle are kept in contact, and where by virtue of catch features the shuttle head is held captive. The contact arms themselves, which are recognized as cantilever beams, have a spring stiffness determined by such parameters as material, cross sectional dimensions, and length. The contact arms are released from the substrate, but their supported ends are of a piece with the electrode bond pads, 96A and 96B, which are not released from the substrate. The spring stiffness of the contact arms are made to assure a good physical pressure is maintained between the interposed shuttle head 55 and the contact arms 92.

Figure 2A:
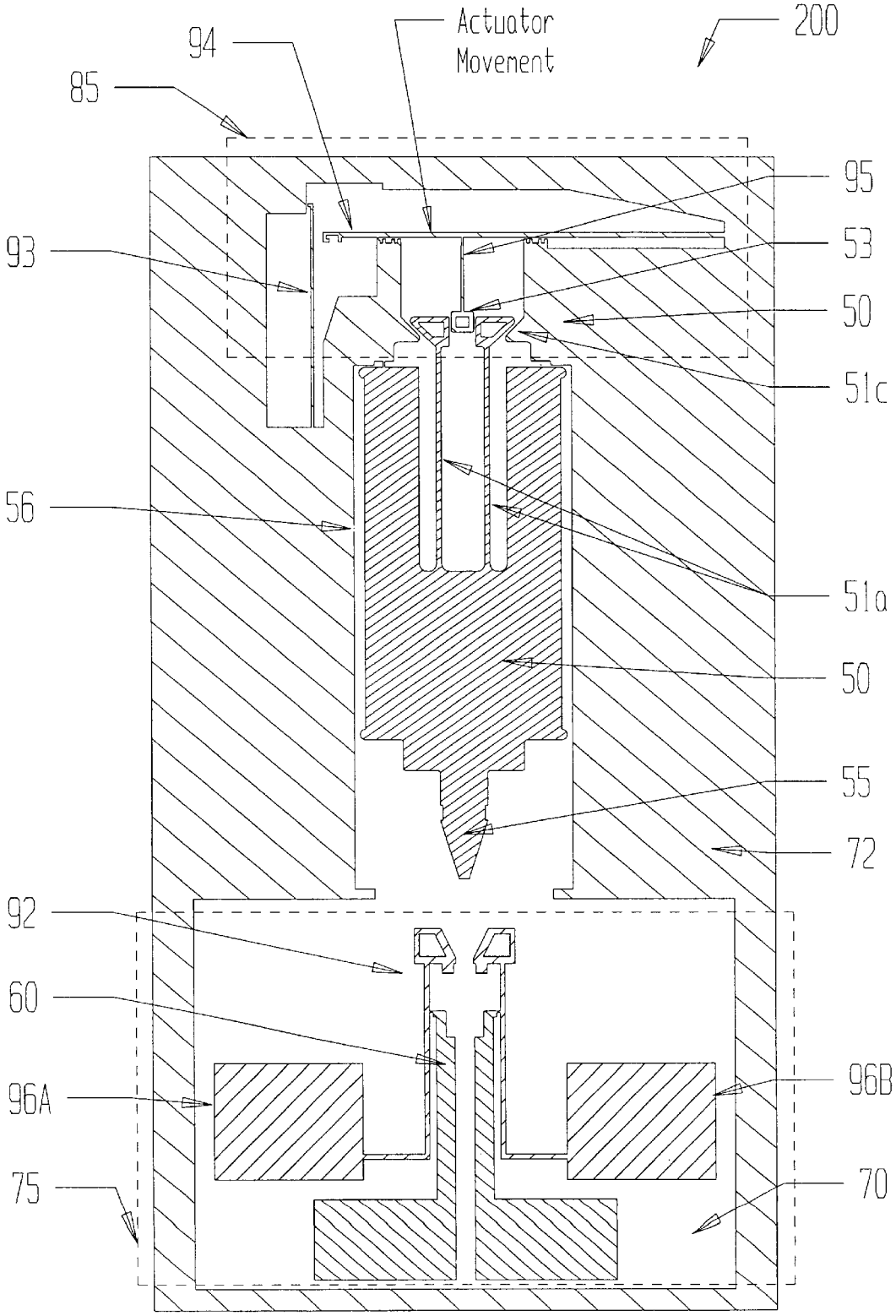
FIG. 2*a* shows an exemplary sectional plan view of a second embodiment of a MEMS unpowered G-switch with mechanical enable capability.
Figure 2B:
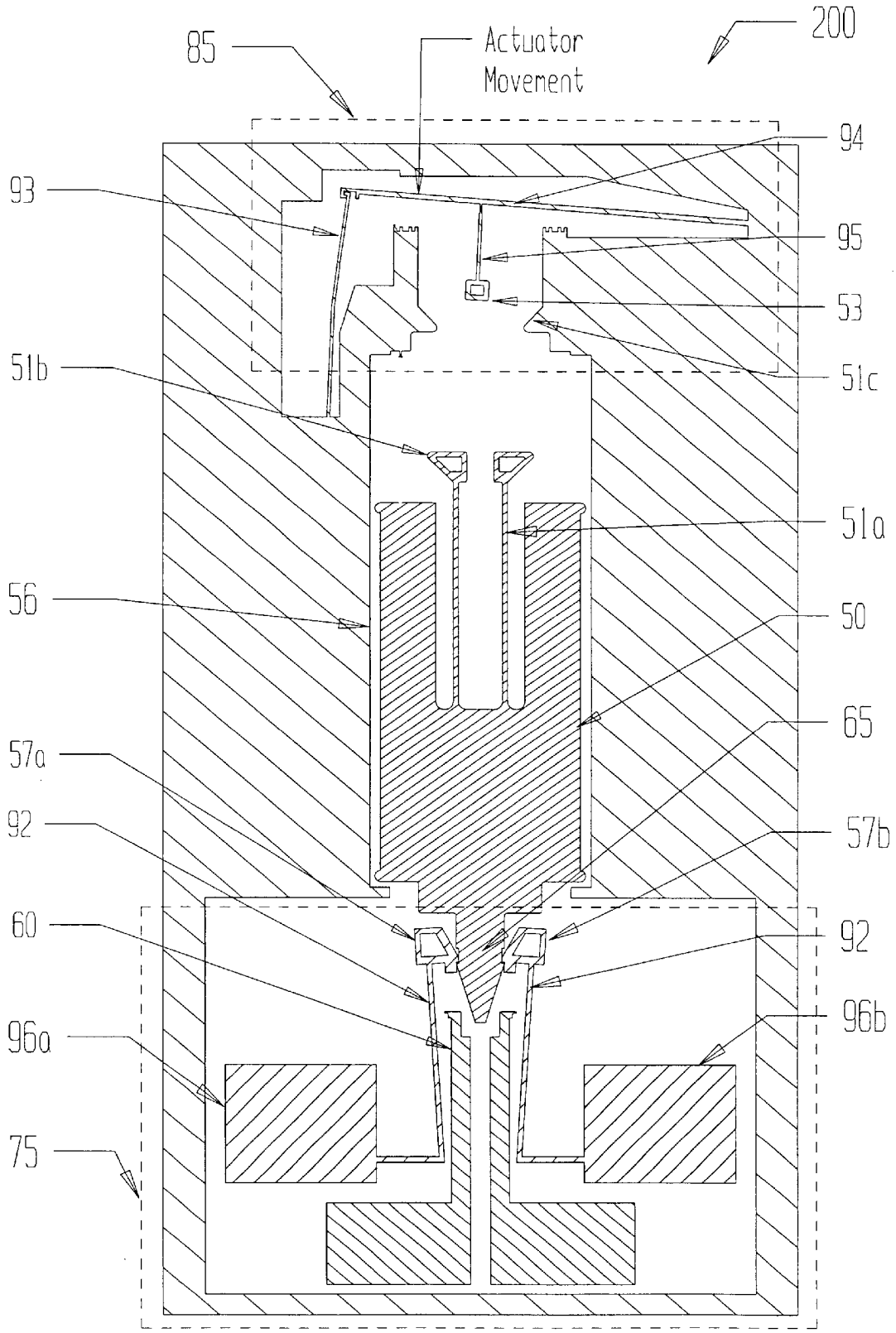
FIG. 2*b* shows a sectional plan view of the device of FIG. 2*a,* wherein a linchpin is retracted, and allowing during inertial loading of the switching device, a shuttle member to close and cause switching action.

The standoff member 60 in FIGS. 2*a* and 2*b* is separated into two halves to prevent electrical shorting prior to switch closure. When the standoff member 60 is made of an electrical insulator-type material, there is no need for separation into halves, conversely when they are made of an electrically conductive material, the left half must support the left contact arm 92 and the right half must support the right contact arm, while maintaining a space between the standoff member 60. The standoff member 60 also has stabilizing extension legs 60*b* and a support members 60*a* to support the anvils 57*a* and 57*b* prior to switching action.

The second embodiment of the invention can also be used as a threshold G-switching device. In such a design, the linchpin 53 and lift arm assembly 85 are omitted, wherein the anchor foot assembly 51 holds the shuttle 50 in an initial configuration until upward acceleration is applied sufficient enough to pull the anchor feet 51*b* through the constriction 51*c*. The accelerating threshold at which the anchor feet pull free is a function of friction, mass of the shuttle, and design of the anchor foot assembly 51.

SWITCHING ASSEMBLIES: Various designs of the switching assembly 75 can be used in either embodiment of the invention. As shown in FIG. 1 (for example) the contact hammers 57*a* and 57*b* interact with the shuttle head 55 to close the switch assembly by acting upon the anvil pair 61 and 62. The switching assembly 75 can be a latching single-throw switch of a type being either a normally-open, double pole, single-throw switch or a normally-open, single pole, single-throw switch.

Figure 3:
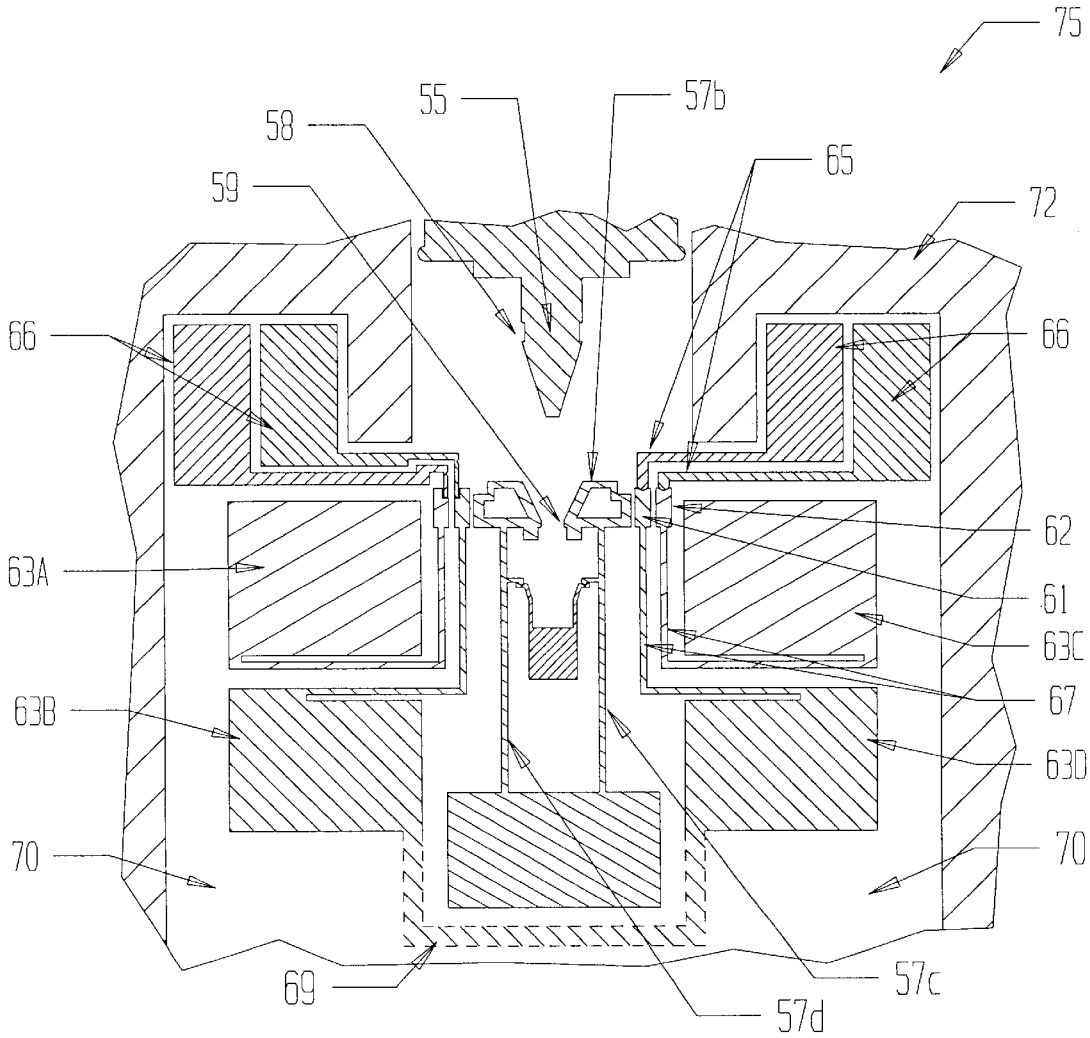
FIG. 3 shows a sectional plan view of incipient closure of one design of a switching assembly shown in FIG. 1.
Figure 4:
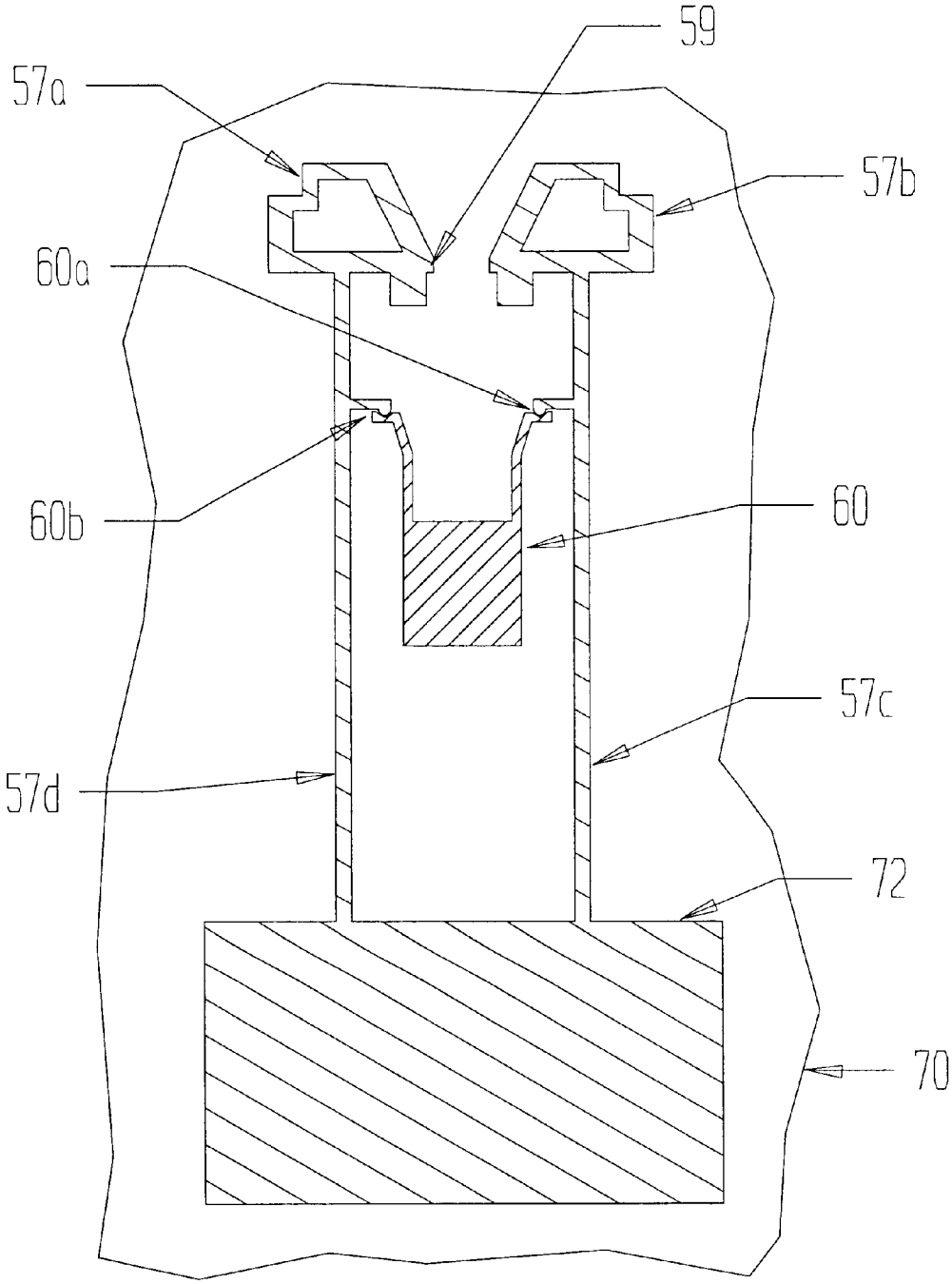
FIG. 4 shows a sectional plan view of a contact hammer standoff feature of the switching assembly shown in FIG. 1.

Referring now to FIGS. 3 and 4, features of the contact hammers 57*a* and 57*b* include: being positionable with space in between to permit insertion of the tapered shuttle head 55; being tapered to provide a slanted entryway to guide the shuttle head; being flexibly supported to allow lateral deflection when shuttle head; having catch engagement features 59 that latches in place the inserted shuttle head; having a related contact hammer standoff feature 60 (FIG. 4) that prevents the contact hammers 57*a* and 57*b* from moving laterally under inertial loading prior to forcible insertion of the shuttle head 55 using leg members 57*c* and 57*d* that are attached to the contact hammers and cylinder in groove coupling members 60*a* and 60*b* that couple to standoff feature member 60; having sufficient structural strength to transmit relatively large compressive forces caused by wedging action of the inserted shuttle head 55, to the adjacent anvils; and being electrically non-conductive unless required.

The electrical contact-anvil pairs 61, 62 and 76, 77 are typically made of a conductive material (either by selection of the intrinsic material or by a process of doping, deposition, plating as required by the method of fabrication) and their function is to be forcibly pressed by the contact hammers into contact with one another. When anvil 61 is pressed against anvil 62 to carry current between bond pads 63A and 63B, and 76 is pressed against 77, to carry current between bond pads 63C and 63D, switching action occurs.

Figure 5:
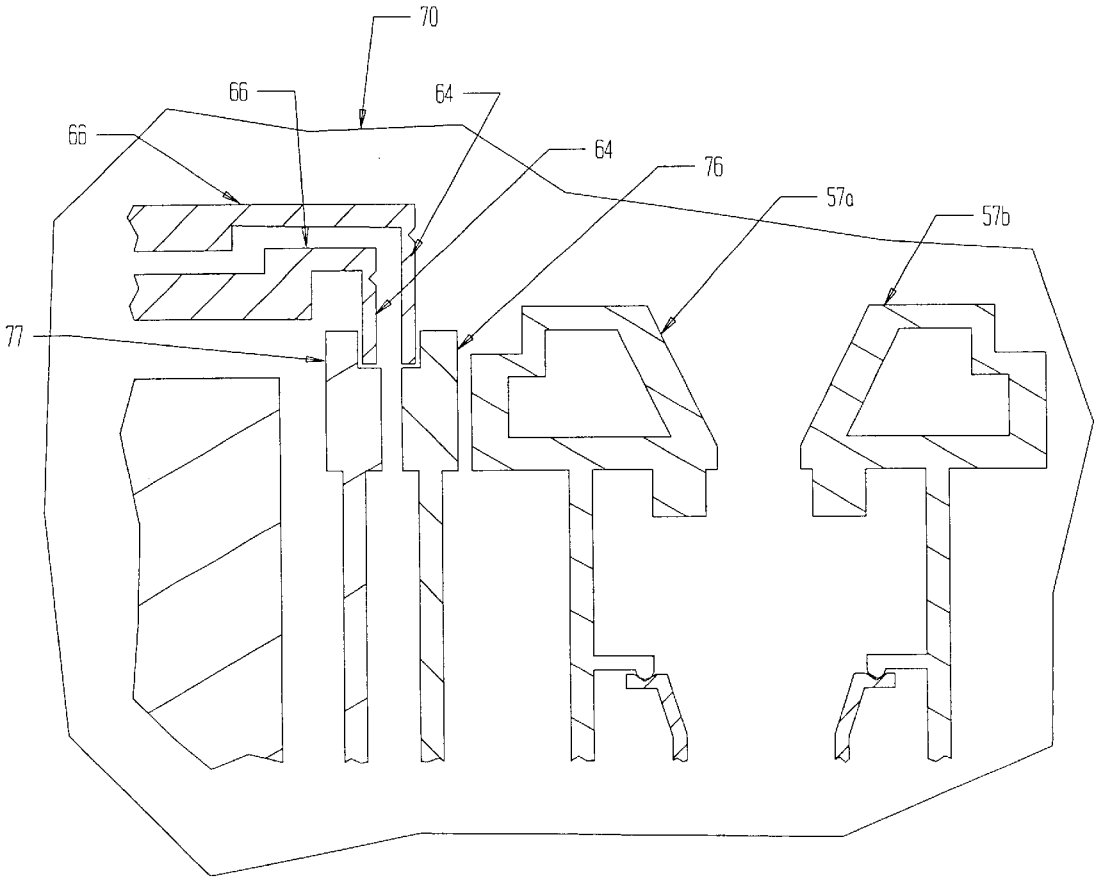
FIG. 5 is a sectional plan view showing breakaway type standoffs that separate contact anvils of the device in FIG. 1.

Referring to FIG. 5, the breakaway standoffs 64 are shown in greater detail to show how they maintain anvil pair 76 and 77 separated until lateral force caused by shuttle head 55 insertion into the switch assembly 75 overloads these standoffs 64 causing them to break or bend at a breakaway weak section. The standoffs each have attachment lands 66 on the substrate, and are electrically isolated from one another. These breakaway standoffs separate the anvils under normal dynamic inputs to prevent the switch from inadvertently closing due to self-loading during inertial loading input events.

Figure 6:
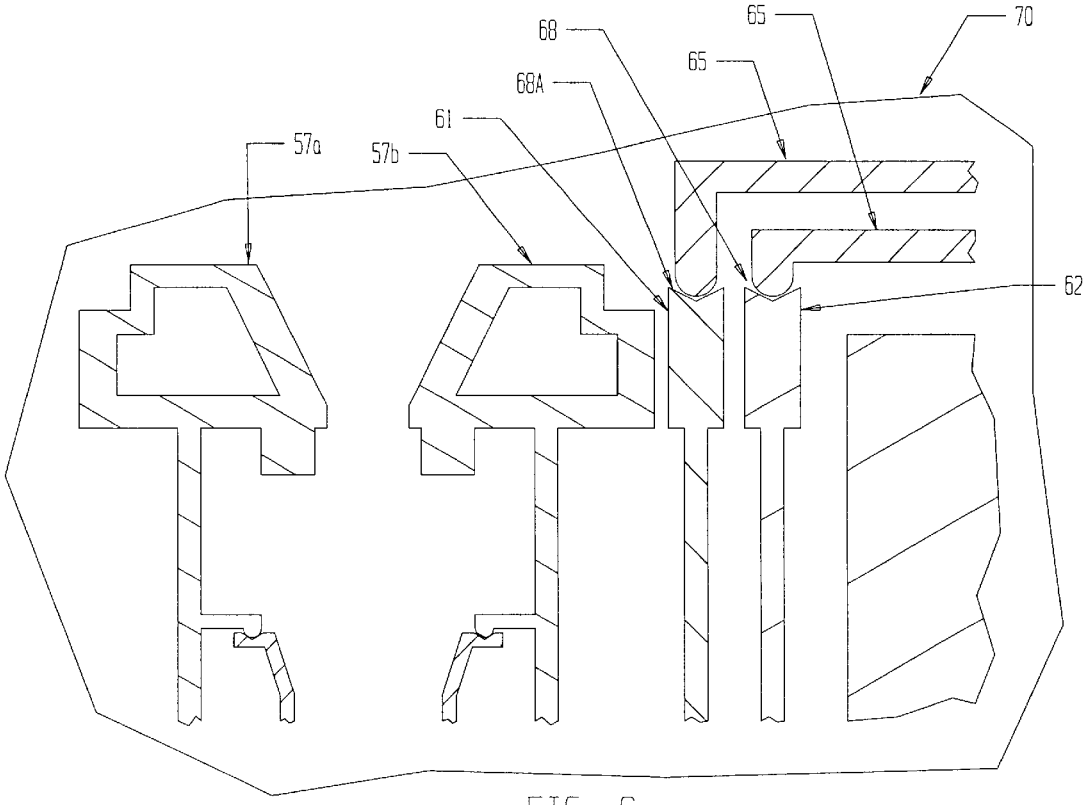
FIG. 6 is a sectional plan view showing sprung-type standoffs that separate contact anvils of the device in FIG. 1.

Referring to FIG. 6, sprung standoff arms 65 provide a similar function as the breakaway-type of standoffs. These sprung standoffs separate anvils 61 and 62 until the lateral force from the shuttle head 55 insertion into the switch assembly overloads them. However, instead of having a breaking feature, the sprung standoffs use a "cylinder in groove" 68 geometry such that a lateral force on the associated anvils cause the anvils to move laterally by forcing the spring arms of the standoffs 65 up and over the cam surface of the "groove" 68A. The standoffs have their own anchor lands 66 that attach to the substrate 70, and are electrically isolated from one another.

The electrical poles and bonding pads 63A, 63B, 63C and 63D in FIGS. 1 and 3 are shown as the anchor lands for the anvil arms 67 and anvil pairs 61, 62 and 76 and 77 but they also serve as electrical bonding pads for the input/output electrical connections of the switching assembly.

Figure 7B:
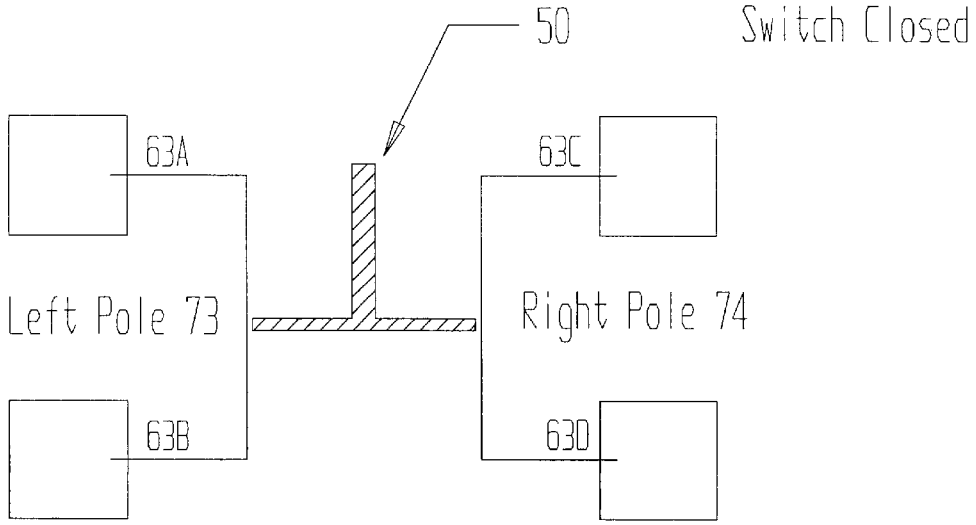

Referring to FIGS. 7*a–f,* wiring diagrams of the switch device 100 is shown. Movement of the shuttle 50 into one of the designs of the switch assembly 75 simultaneously connects pad 63A to 63B and 63C to 63D, see FIG. 7*b*. In FIGS. 7*a* and 7*b*, the switching assembly comprises a normally open, double-pole, single throw (DPST) switch device. This configuration of the switching assembly can switch power or signal or both, including switching power on one pole (e.g., pole 63A and 63B) and switching signal on the other pole (e.g., pole 63C and 63D).

Figure 7C:
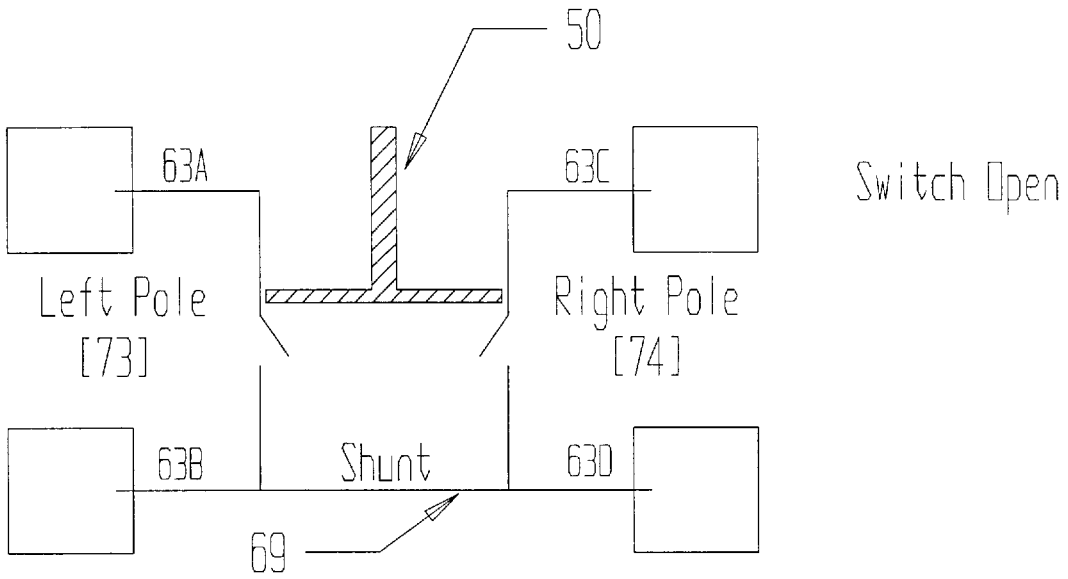
Figure 7D:
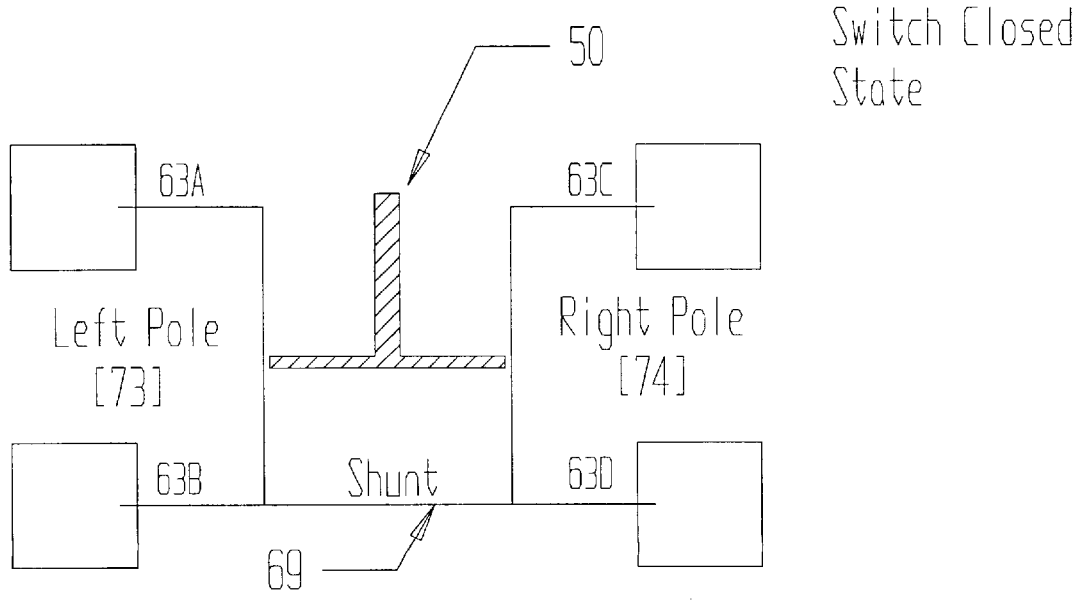

FIGS. 7*c* and 7*d* show the switching device as a variation of the DPST wherein using a shunt connection at the output as a common node between pads 63B and 63D so as to enable a common voltage potential at the output of the switching device.

Figure 7E:
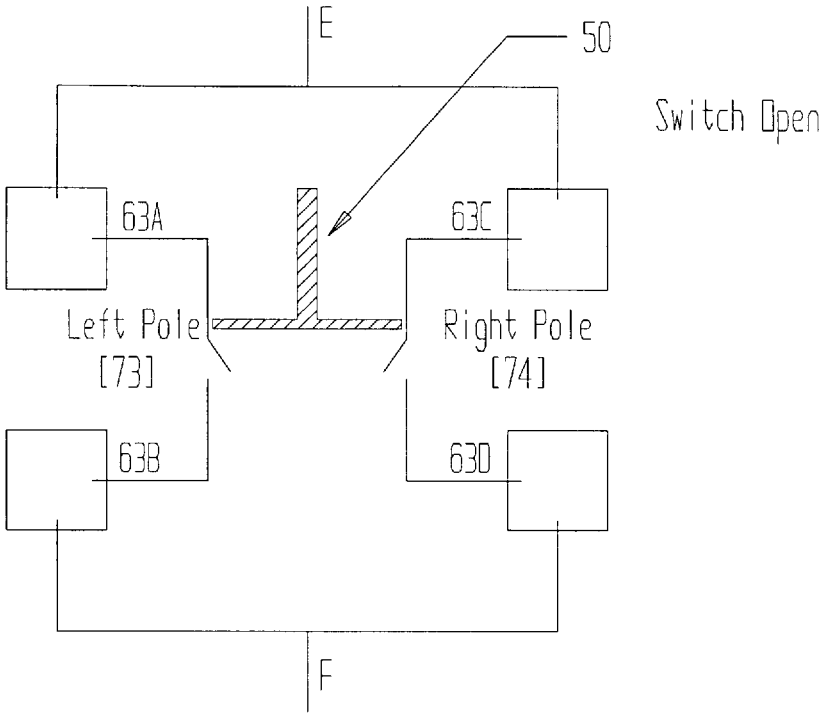
Figure 7F:
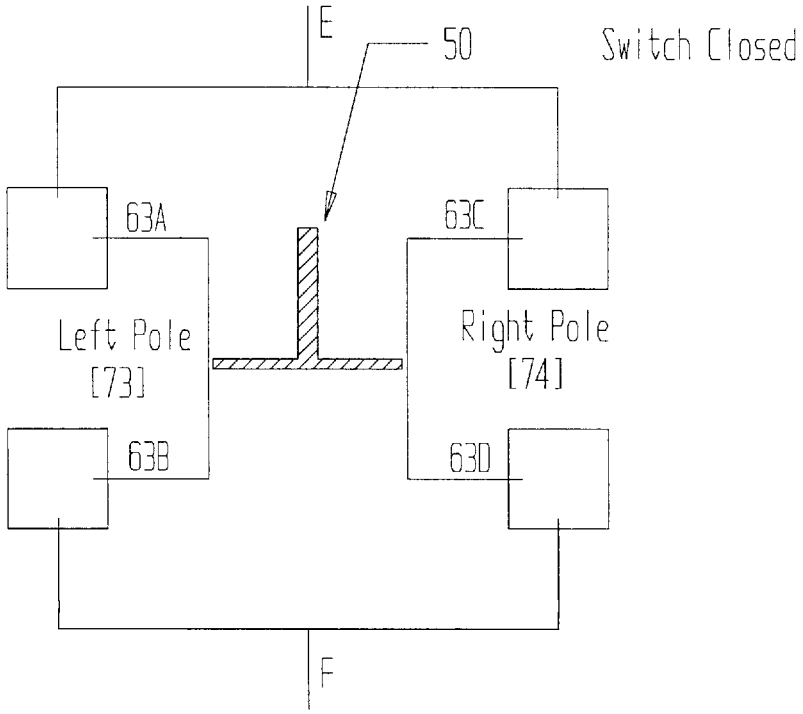

FIGS. 7*e* and 7*f* shows a normally open, single-pole, single throw (SPST) switching configuration that is able to carry twice the current that either one of the above double-pole switches can carry given that the size of the pads and connections remain the same. An optional bond pad connector 69 may be fabricated with this design to reduce the number of input/output wire leads by one for the SPST configuration. There has been some rewiring external to the switching assembly to connect the electrical poles in parallel, so that nominally twice the current capability of either pole is available between new external poles E and F.

METHOD OF USE AND MAKING: The various designs of the invention, as discussed above, can be used to provide a miniature high-current switching device used in various military applications by providing a mechanically-enabled, latching mechanical inertial switch (G-switch) device; an electromechanically enabled latching mechanical G-switch device; a miniature unpowered inertial t-zero or power switch device to enable electronic circuits within either gun-launched or tube-launched based weapons or instrumentation packages (for example, flight recorders or telemetry packages). Environments in which the invention can be used include sea and water-type vehicles, space borne instrumentation packages, and all types of safety and emergency response systems. The G-switch devices can function in non-lethal weapons, by virtue of the small size and therefore light weight of the MEMS S&A compared to a conventional mechanical G-switch device. The MEMS device is smaller and therefore of less mass, and can be considered "frangible" in association with an electromechanical assembly that it forms a part of.

In particular, these embodiments can be used for turning-off or turning-on instrumentation packages upon impact, provide t-zero or t-impact signals; allow for a miniature unpowered threshold impact switch that electronically enables weapon circuits or features upon impact or penetration (note that whole-body acceleration is a safer way to sense impact than using a crush switch, which can be inadvertently activated or damaged in handling, so this invention represents a potential improvement over crush-switches used for impact sensing in weapons); inertially-induced switching of arming energy circuit in a fuze safety and arming device; neutralizing or bleeding down powered circuits on weapons that fail to function in the intended time period (that is, prior to impact or after a programmed delay after impact); impact-induced safety bleed-down of circuit or battery in a system that has suffered an impact (for example, due to cargo or equipment mishandling, accident situations, explosions, vehicle impact, or to intended conditions in test or deployment situation; electronically interrogatable uniaxial threshold-G (acceleration threshold) event recorder, or to use different terminology, an impact telltale that can be examined for evidence of blast or impact long after an incident has occurred; miniature unpowered inertial switch for detection of impact and enablement of an electronic circuit that deploys a response to the impact condition (for example, the invention device could enable an impact-mitigating air bag or a visual or auditory damage warning).

Other applications of the invention include, but are not limited to, safety and arming pyrotechnics, flown instrumentation packages, and actuators for or in automotive impact sensing. The features and characteristics of the invention include, but are not limited to, development of a devices that are substantially planar in form, which affords improved size and shape advantages when compared to functionally-comparable and traditional three-dimensional devices such as fuzes, switches, and assemblies that may not require electrical power to function during initial arming stages, as well as other features and characteristics discussed and described herein.

In the latter discussion, the term "flown instrument packages" indicates an arrangement in which the device, instead of arming a fuze, closes a switch that initiates data recording aboard a tube-launched instrumentation package. The phrase "actuators for or in automotive impact sensing" indicates an application similar to the above "flown instrumentation packages" application but, in the automotive environment, the shuttle with zig-zag feature responds to crash deceleration to work its way down the zigzag track, and it locks down and closes the switch the switch when a certain minimum velocity change occurs. The device also can act as a mechanical impact switch that closes upon first impact, with the crushing of the vehicle structure, for example. The inertial switch closing constitutes detection that closes a switch at its end of travel, and this fires an airbag or other automotive safety device. Thus, the present invention is not necessarily limited to fuzing S&A applications.

In summary, the invention generally relates to the field of mechanical S&A devices for projectiles and munition fuze S&A devices using micromachining, microscale device and MEMS technologies. As described above, the invention disclosed herein preferably is used in a mechanical fuze S&A device on a single die. Any solid material or combination of materials can be used to form the shuttle member, anchor assembly and switching assemblies of the present invention. In the preferred embodiment, the invention includes a slider and racks formed of metal (e.g., nickel) using a LIGA-MEMS fabrication process, but other micro-fabrication processes or other materials (including other metals, ceramics or polymers, or even crystalline materials such as silicon or quartz) can be used. The material chosen is not critical to practice the invention, but such material selection should enable one to produce the device to function as taught herein. The device can be sandwiched between one or more other die that act together to enable arming and safety functions for a fuze.

In addition, the height (relief) of the features is not critical, given the fact that there is enough material for the shuttle member 50, slide track 56 and one of the designs of the switching assembly 75 to interact as intended. Current LIGA processes create features whose top surface is about 200-microns above the substrate, but the device may work just as well with only a 25- or 50-micron height. Any technology may be used to form the device, whether a LIGA-type process or a bulk plasma micromachining technique such as RIE (reactive ion etching), or a surface micromachining technique, or some other process yielding the desired configurations.

Preferably, each switching device is fabricated on a die approximately one square centimeter or less in area and about 500-microns thick. As mentioned above, preferably, each device is implemented on a single chip or die, but multiple dies also can be used. In a preferred embodiment of the invention, the device is monolithic in its basic configuration, but also, for practical purposes, can be sandwiched or stacked with one or more die. MEMS devices can be readily integrated and interfaced with electronics because they are fabricated much the same way as integrated circuits. The specific MEMS fabrication technique requires only that desired geometries and mechanical and electrical performance characteristics are obtained for an intended application. The moving parts of the embodiments 100 and 200, that is the shuttle 50, linchpin 53, and the moving switch parts of any one of the switch assembly 75 designs are freed from the fabrication substrate 70, and are held in plane by the substrate 70 and a cover plate for protection and reliability of freedom of moving parts (not shown). The features that are attached to the substrate and form the land structures 72 are shown that include the anchor assembly's constriction members 51*c*, the track 56 and the various electrical bonding pads. There is a working clearance between the moving parts and the substrate/cover plate planes. Preferably, each of the embodiments of the invention when used in fuze applications is stackable such that the G-switch die can be augmented by sandwiching it between other die or cover plates that add more features or provide data pick-off.

In addition, each embodiment of the invention is preferably designed and manufactured with high precision using microfabrication technology, based on optical masks. The device brings with it a high degree of precision, with features on a scale ranging from millimeters in dimension to microns in dimension. Also, the required features may be created using any of a variety of micromachining techniques. The most likely fabrication technology for producing copies of the invention is the high-aspect-ratio (HAR) LIGA technique or other HAR bulk micromachining techniques, such as reactive ion etching, (RIE) or the like, to create the intended features on a planar substrate.

Packaging of the switching device can be hermetic with a selection of fill gas. Additionally, by varying certain parameters, a particular switching device design can accommodate a variety of threshold levels wherein the g-threshold for pull-out of the anchor is set by selection of parameters such as anchor leg dimensions, required anchor foot deflection as discussed in my other related patent application referenced above. Electrical current carrying capacity, and applications, through relatively simple modifications to the wafer exposure masks and MEMS process parameters, versus retooling an assembly line with conventional G-switches, allows for packaging that is flexible using either a flip-chip, surface mount, or regular chip carrier, according to need. Aspects of the switch assembly 75 performance can be tailored by relatively simple design changes such as for a requisite acceleration threshold, voltage standoff, dwell (plunger travel time as influenced by zig-zag track delay), stroke and/or contact forces.

It will be readily apparent to one of ordinary skill in the art that the present invention fulfills the objectives set forth above. After reading the foregoing specification, those skilled in the art will be able to effect various modifications, changes, substitutions of equivalents and various other aspects of the invention as broadly disclosed herein. It is therefore intended that the protection granted hereon be limited only by the scope of the invention as set forth in the appended claims and equivalents thereof.

What is claimed is:

1. A microelectromechanical systems (MEMS) type switching device, the device comprising:

a base;

a sliding shuttle member slidably mounted on the base;

an anchor assembly having at least one flexible anchor leg attached to the shuttle member wherein the at least one anchor leg cooperatively and slidably engages a constriction member through at least one movable anchor foot attached to a distal end of each anchor leg, the constriction is attached to the base; and an electrical switching assembly attached to the base wherein the shuttle member has a head member that actuates the switching assembly when the switching device is subjected to inertial loading.

2. The device as recited in 1, wherein the anchor assembly consist essentially of the at least one flexible anchor leg attached to the shuttle member wherein the at least one anchor leg cooperatively and slidably engages a constriction member through the at least one movable anchor foot attached to a distal end of each anchor leg, the constriction is attached to the base, thereby providing a threshold gravitational (G)-switch.

3. The device as recited in 1, wherein the anchor assembly further includes a means for enabling the switching-device and there are two anchor legs and two anchor feet.

4. The device as recited in 3, wherein the means for enabling the switching device comprises:

an electromechanical actuator and a movable linchpin, wherein the electromechanical actuator attaches to at least two electrical bonding pads, a first end of the linchpin member slidably moves within the electromechanical actuator and the other end of the linchpin slidably moves between the anchor feet, whereby when the means for enabling the switching device is actuated, the linchpin slides out from between the anchor feet, thereby allowing the anchor feet to move towards each other and allowing the shuttle member to slide when the switching device is subjected to inertial loading.

5. The device as recited in 3, wherein the means for enabling the switching device comprises a mechanical lift arm assembly that attaches to a support member for a lift arm, the lift arm attaches to a the linchpin when the support member is moved by an external actuator means, the other end of the linchpin slidably moves between the anchor feet, whereby when the lift arm assembly is actuated, the linchpin slides out from between the anchor feet, thereby allowing the anchor feet to move towards each other and allowing the shuttle member to slide when the switching device is subjected to inertial loading.

6. The device as recited in 1, wherein the sliding shuttle member is juxtaposed to a zig-zag track on each side of the shuttle member, in which the shuttle member slides, the shuttle member has teeth members on each side of the shuttle member that cooperatively slidably engage the zig-zag track members, thereby enabling time-delay for travel of the shuttle member when subjected to inertial loading.

7. The device as recited in 1, wherein the electrical switching assembly comprises:

at least one pair of movable contact hammer members that are attached to the base, the hammer members cooperatively engage the shuttle's head member during actuation of the switching assembly; and at least one pair of electrical bonding pads that are attached to the base and are for external electrical connection to the switching device.

8. The device as recited in 7, wherein the at least one pair of electrical bonding pads are electrically connected to the at least one pair of contact hammer members, wherein each hammer member has an electrically conductive surface coating material, and the shuttle's head member has an electrically conductive surface coating material, whereby the head member causes switching action during contact by the at least one pair of hammer members.

9. The device as recited in 7, wherein the electrical switching assembly further includes at least two pairs of electrically conductive contact anvils that are flexibly attached to the base and electrically isolated from each other, each anvil member is electrically attached to a bonding pad member that is attached to the base, and each pair of the anvils are juxtaposed to one of the contact hammer members, whereby when the head member causes switching action by engaging the at least one pair of hammer members with each of the respective pairs of the anvil members, the anvil members engage each other thereby effectuating switch closure.

10. The device as recited in 9, further comprising a standoff member for each of the anvil members, each of the standoff members are attached to the base and proximal to its respective anvil member, whereby each of the anvil members are stabilized prior to a switching event during inertial loading of the switch.

11. The device as recited in 10, wherein each of the standoff members is a breakaway-type of member and distal ends of each of the standoff members has a break-off section that is substantially juxtaposed to the distal end of its respective anvil member.

12. The device as recited in 10, wherein each of the standoff members is a sprung-type movable member and distal ends of each respective pair of standoff member and anvil member cooperatively forms a cylinder-in groove coupling, thereby providing initial stabilization of the anvil member and subsequent translational movement thereof upon activation of the switching assembly.

13. The device as recited in 7, wherein the electrical switching assembly further includes a contact hammer standoff member that attaches to the base, the contact hammer standoff member has arms whose distal ends cooperatively form a cylinder-in groove coupling with a respective contact hammer leg member, thereby providing initial stabilization of the hammer members prior to activation of the switching assembly.

14. The device as recited in 7, wherein the electrical switching assembly further includes a contact hammer standoff member that attaches to the base, the contact hammer standoff member has arms whose distal ends cooperatively have break-off tab members with its respective contact hammer leg member, thereby providing initial stabilization of the hammer members prior to activation of the switching assembly.

15. The device as recited in 7, wherein the electrical switching assembly is a normally open, single-pole, single-throw switch.

16. The device as recited in 7, wherein the electrical switching assembly is a normally open, double-pole, single-throw switch.

17. The device as recited in 15, wherein the electrical switching assembly is a normally open, single-pole, single-throw switch and the switching assembly further includes an electrically shunt member that is attached to the base and the shunt member connects to at least two bonding pad members.

18. The device as recited in 7, wherein the head member of the shuttle member on each side has a catch engagement recess section that cooperatively engages and latches with each of the contact hammer members during inertial loading of the switching device.

19. A microelectromechanical switching device, the device comprising:

a base;

a sliding shuttle member slidably mounted on the base;

an anchor assembly having at least one pair of flexible anchor legs attached to the shuttle member wherein the at least one pair of the anchor legs cooperatively and slidably engages a pair of constriction members through at least one pair of movable anchor feet attached to distal ends of the anchor legs, the constriction members are attached to the base, and an electromechanical means for enabling the switching device that includes an electromechanical actuator and a movable linchpin, wherein the electromechanical actuator is attached to at least two electrical bonding pads, a first end of the linchpin member slidably moves within the electromechanical actuator and the other end of the linchpin slidably moves between the anchor feet; and an electrical switching assembly that is attached to the base wherein the shuttle member has a head member that actuates the switching assembly when the switching device is subjected to inertial loading, whereby when the electromechanical means is actuated, the linchpin slides out from between the anchor feet, thereby allowing the anchor feet to move towards each other and allowing the shuttle member to slide when the switching device is subjected to inertial loading.

20. A microelectromechanical switching device, the device comprising:

a base;

a sliding shuttle member that is slidably mounted on the base;

an anchor assembly having at least one pair of flexible anchor legs that are attached to the shuttle member wherein the at least one pair of anchor legs cooperatively and slidably engages constriction members through at least one pair of movable anchor feet that are attached to distal ends of each anchor leg, the constriction members are attached to the base, and mechanical means for enabling the switching device, the mechanical means includes a mechanical lift arm assembly that attaches to a support member for a lift arm, the lift arm attaches to a linchpin when the support member is moved by an external actuator means, the other end of the linchpin slidably moves between the anchor feet; and an electrical switching assembly that is attached to the base wherein the shuttle member has a head member that actuates the switching assembly when the switching device is subjected to inertial loading, whereby when the mechanical means is actuated, the linchpin slides out from between the anchor feet, thereby allowing the anchor feet to move towards each other and allowing the shuttle member to slide when the switching device is subjected to inertial loading.

* * * * *